US006471328B1

(12) United States Patent
Becker et al.

(10) Patent No.: US 6,471,328 B1
(45) Date of Patent: Oct. 29, 2002

(54) FLUID HEAD CLEANING SYSTEM

(75) Inventors: Ronald Joseph Becker, Endicott; Gerald Andrew Kiballa, Owego; Wayne David Klossner, Vestal, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 08/888,866

(22) Filed: Jul. 7, 1997

(51) Int. Cl.[7] ..... B41J 2/165
(52) U.S. Cl. ..... 347/28
(58) Field of Search ..... 347/27, 22, 28, 347/49; 134/1

(56) References Cited

U.S. PATENT DOCUMENTS 4,691,725 A * 9/1987 Parisi ..... 134/1
4,849,769 A * 7/1989 Dressler ..... 347/27
5,339,842 A * 8/1994 Bok ..... 134/1
5,409,594 A * 4/1995 Al-Jiboory et al. ..... 134/1
5,505,785 A * 4/1996 Ferrell ..... 134/1
5,534,076 A * 7/1996 Bran ..... 134/1
5,574,485 A * 11/1996 Anderson et al. ..... 347/27
5,585,825 A * 12/1996 Kneezel et al. ..... 347/14

* cited by examiner

*Primary Examiner*—John Barlow
*Assistant Examiner*—Michael S Brooke
(74) *Attorney, Agent, or Firm*—Douglas M. Clarkson

(57) ABSTRACT

A system for cleaning clogged orifices of a fluid head includes both apparatus and method by which reverse flow of a cleaning solution is combined with providing the vibrational energy of an ultrasonic frequency generator to the fluid head. A liquid pump and a filter interconnect between the input terminal of a fluid head to be cleaned and the input to the cleaning chamber of the apparatus so that a liquid cleaning solution reverse flushes the clogged fluid head, while the ultrasonic frequency generator is providing vibrational energy to break loose stubborn clogs.

5 Claims, 2 Drawing Sheets

FLUID HEAD CLEANING SYSTEM

BACKGROUND OF THE INVENTION

1. Field of the Invention

The present invention, generally, relates to fluid heads used in several environments and, more particularly, to a system for cleaning these fluid heads.

With the introduction of ink jet printers, much concern has evolved over the tendency of the small holes in their print heads becoming clogged. Therefore, at first, much effort was spent on avoiding these clogs, but as the printer technology developed and as the use of a fluid head in other and different equipment, such as recorders, for example, cleaning of the fluid heads has become more necessary rather than convenient.

2. Related Background Art

U.S. Pat. No. 4,296,418 to Yamazaki et al. describes printing apparatus to sense a clog automatically and to clear the nozzle by flushing with air and a solvent.

U.S. Pat. No. 5,128,690 to Nozawa describes apparatus using heat and pressure to create a liquid flow to flush foreign matter from the discharge openings.

European patent No. 0 292 779 describes a component cleaning method where internal passages of ink nozzle printing heads are cleaned by flushing with liquid; ultrasonic waves cause a vibratory cavitation in the internal passages.

Japanese patent No. 4-39055 describes the cleaning of an ink jet nozzle using jettisoned cleaning fluid against the surface of an ink jet nozzle; the wash material is accumulated in a chamber and discharged by suction pumps.

Japanese patent No. 7-329310 describes cleaning jet nozzles of a textile printing machine by placing an ultrasonic vibration plate underneath the ink jet nozzle.

Japanese patent No. 56-106868 describes a method of clearing a clogged nozzle using ultrasonic vibrations to crush or dissolve the clogged material and flush it to the outside.

IBM Technical Disclosure Bulletin No. 1802, November, 1974, describes an anti-clogging ink jet chamber having an ultrasonic driver connected to it so the chamber does not have to be removed.

Now, however, these prior efforts, when used with present day apparatus, are proving to be either disappointing in their effectiveness or completely inadequate. Fluid heads used with today's apparatus involve materially different structures.

For example, the ink discharged, in early days, was through "openings" in an ink chamber. Then, technology advanced, or improved, to a point where ink was discharged through small holes.

Next, the "holes" were reduced to very small; then "tiny holes". In many apparatus today using fluid heads, ink, or other solution, is passed through "orifices" that measure in the thousandths of an inch and spacing between them is comparable.

Today, when a fluid head becomes clogged, methods that were completely satisfactory yesterday, are totally in-effective.

SUMMARY OF THE INVENTION

It is an important object of the present invention to provide a method of cleaning fluid heads that have become either permanently or intermittently clogged.

It is also an important object of the present invention to provide apparatus that cleans today's fluid heads effectively at a cost that is equally attractive.

Briefly, a structure that is in accordance with the principles of the present invention includes a housing with a chamber to receive a fluid head, means to hold a fluid head within the chamber, a pump, a filter, an ultrasonic frequency vibrator, and hoses to interconnect the respective components. A method that is in accordance with the present invention involves retaining a clogged fluid head within the chamber of the housing, filling the chamber to a predetermined level with a solvent that is impervious to both the fluid head and to chamber plastic, connecting a pump with a means to filter the fluid to the chamber to move the fluid in a back-flow direction through the fluid head, and inducing vibrations in the fluid in an ultrasonic frequency range.

The above, other and further objects, advantages and features of the present invention will become clear from a perusal of the following detailed description of a presently preferred embodiment.

DETAILED DESCRIPTION OF THE INVENTION

Figure 1:
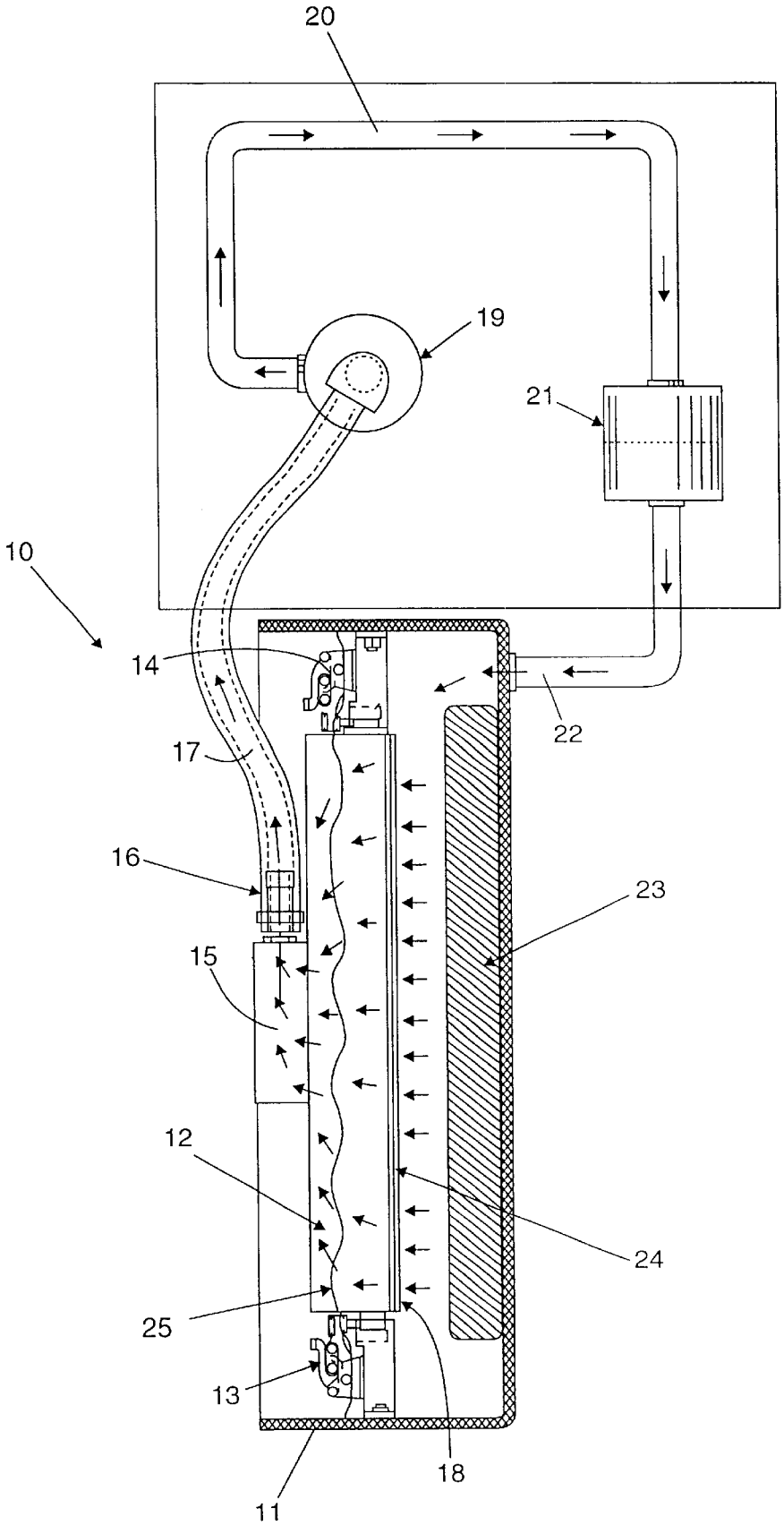
FIG. 1 is a view in elevation of a structural arrangement of components interconnected to obtain the benefits of the invention.

Referring first to FIG. 1 of the drawings, a housing 10 identifies generally the apparatus arranged according to the principles of the present invention. It is significant that the housing 10 is a stand alone structure, and it is formed to provide a chamber 11 of sturdy construction not only to withstand vibrations itself but to transmit the vibrations to a fluid head 12 to be unclogged and flushed.

The fluid head 12 is supported firmly within the chamber 11 by two brackets 13 and 14. Since these brackets can be formed in any desired manner to suit an individual preference, further details on the particular support brackets 13 and 14 is not considered to be necessary here, since it may divert attention from the principal structural arrangement that characterizes the invention.

It is also significant to note that the fluid head 12 is supported with its inlet terminal 15 up, where its input connection 16 can be readily attached to a liquid flow tube 17. The surface with the clogged orifices, identified generally by the numeral 18, is facing down toward the bottom surface of the chamber 11.

Continuing the description of the apparatus of the invention, the liquid flow tube 17 is connected from the fluid head inlet terminal 15 to a pump 19, and a liquid flow tube 20 connects the liquid output side of the pump 19 to a filter 21. From the filter 21, a liquid flow tube 22 connects to an inlet of the chamber 11.

An ultrasonic frequency generator is identified generally by the numeral 23 and is located firmly at the bottom surface of the chamber 11. From this location, the ultrasonic frequency generator 23 provides vibrational energy through the housing 10, through the chamber 11, through the support brackets 13 and 14 that clamp a fluid head 12 firmly within the chamber for cleaning.

A cleaning liquid 24 fills the chamber 11 to a predetermined level, indicated by the reference numeral 25, is sufficient to cover about one-half of the fluid head 12 in its supported position within the chamber.

The cleaning liquid 24 is any desired solution with general cleaning characteristics, but it should not be of a type that could harm or produce damage to the material of which the fluid head 12 is formed. It has been found that usually a cleaning solution that does not attack, or is otherwise harmful to, material known throughout the commercial world as PVC, CPVC or poly-propylene is entirely satisfactory for this cleaning solution.

Cleaning the fluid head 12 has proven to be more difficult than was ever anticipated, and the difficulty is largely due to its enclosed structure. The many extremely small orifices that make up the fluid heads of today's equipment are unusually susceptible to becoming clogged with debris of many sizes that enter with the spray solutions. The fluid head 12 has a single inlet port and many extremely small outlet orifices.

The foreign matter entering the fluid head 12 with the solution during use will enter through the large terminal 15, and if that foreign matter cannot exit through one of the orifices, it can clog the orifice. Many of these clogged orifices are not easily, or readily, unclogged.

With the ink used in many of the printers today and with the other fluids used with other wet process equipment, these clogs cannot be removed even with reverse flushing. Such reverse flushing, however, has been quite effective in the past.

Figure 2:
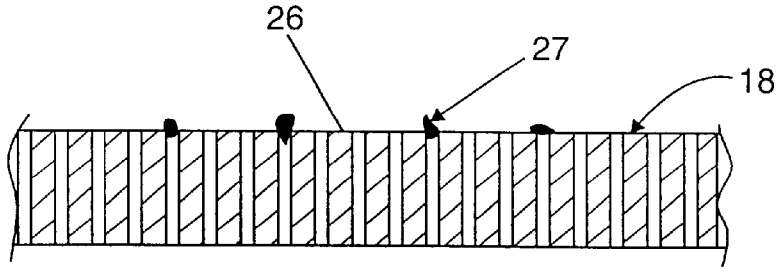
FIG. 2 is an illustration of orifices in a fluid head along the line 2—2 in FIG. 4 that has clogs of foreign material to be removed by the present invention.

In FIG. 2 of the drawings, a plurality of orifices are identified by the numeral 26. As described hereinabove, these orifices 26 are extremely small, and in this view, the numeral 27 illustrates foreign matter and debris that clogs an orifice.

Figure 3:
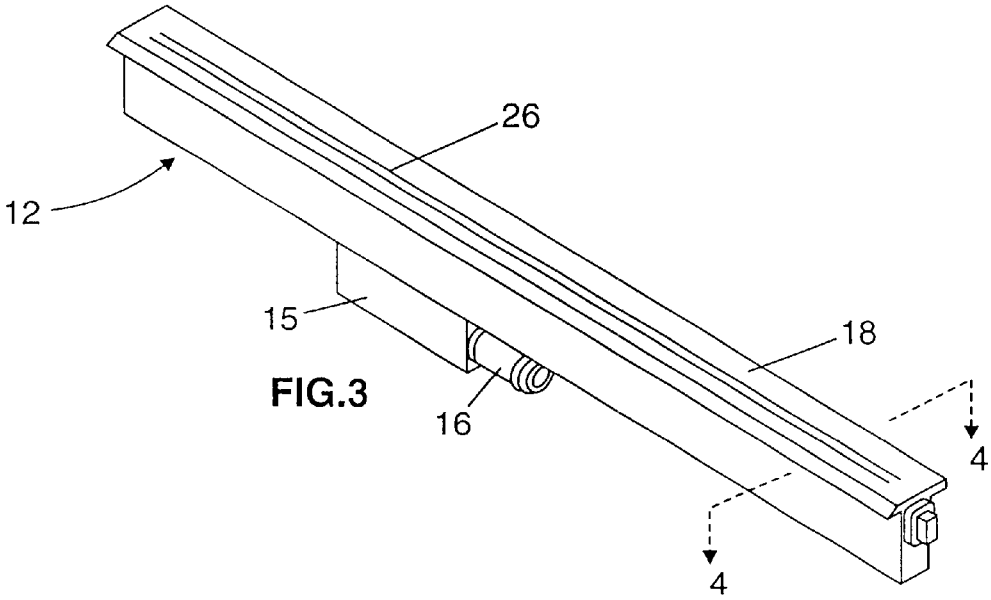
FIG. 3 is a view in perspective of a fluid head with which the present invention is functional.

FIG. 3 illustrates a fluid head 12 inverted from the position as seen in FIG. 1 and in FIG. 2. Here the surface 18 with orifices 26 is facing up, and the inlet terminal 15 with its fluid input connection 16 is facing down.

Figure 4:
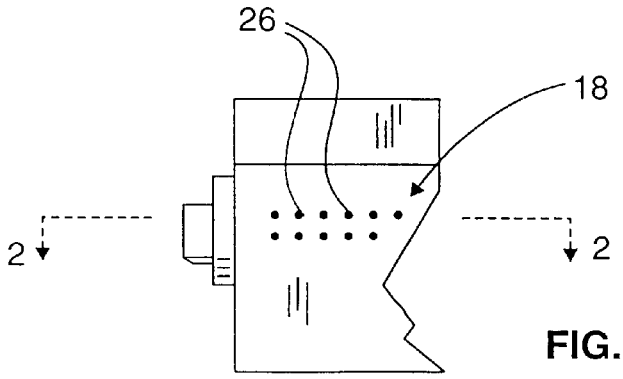
FIG. 4 is a view taken along the line 4—4 in FIG. 3 illustrating the orifice arrangement in the fluid head.

FIG. 4 is an enlarged view of only a part of the fluid head 12 in the same position illustrated in FIG. 3. In this view, the orifices 26 can be seen more clearly as being arranged in two rows. Of course, the particular number of the rows as well as their arrangement is related to the equipment with which the fluid head is used, rather than related to the method of the present invention of affecting their cleaning.

The method in accordance with the present invention has been found to be unusually effective in clearing stubborn clogs as well as cleaning the entire fluid head. To describe the method in detail, refer to FIG. 1 of the drawings.

The method of using the apparatus described above in order to accomplish removal of foreign matter and other debris clogging the respective orifices 26 requires the housing 10 with the chamber 11 with suitable brackets 13 and 14 to clamp the fluid head 12 firmly in the particular position illustrated.

The chamber 11 is filled with a cleaning solution to a level so that with all components connected and operating, the solution covers about one-half of the fluid head 12. The fluid head is supported so that the orifices are completely submerged and so that the orifices face, generally, the input direction of the cleaning solution flow to maximize the reverse flow cleaning.

The chamber 11 is subjected to vibrations at an ultrasonic frequency level during the cleaning operation. With the cleaning solution passing through the fluid head in a direction opposite that in which a dye, or other fluid, flows during a functioning of the equipment normally, this can be referred to as reverse flow during cleaning according to the present invention.

Therefore, with a combination of reverse flow of the cleaning solution while the clogged fluid head is subjected to ultrasonic vibrations, even the most stubborn clogged orifice is cleaned.

While the present invention has been described in substantial detail, various modifications may be made without departing from the spirit and scope of the invention, which is defined by the following claims.

What is claimed is:

1. A method for removing relatively solid material from an outlet orifice of a fluid treatment device including a fluid container with a plurality of orifices adapted to pass fluid in a first direction, said method comprising the steps:

providing a housing defining a chamber sufficiently large to receive said fluid container and formed of a predetermined plastic material of a rigidity sufficient to conduct vibrational energy;

providing a preselected liquid as a cleaning solution to said chamber-at a predetermined rate of flow such that said liquid maintains a preset level within said chamber including withdrawing said liquid from said chamber by pumping;

said preselected liquid as a cleaning solution being of a type that does not attack plastic material;

positioning said fluid container of said fluid treatment device within said chamber of said housing firmly so that said plurality of orifices are submerged in said liquid;

passing said liquid through said plurality of orifices in a second direction substantially opposite said first direction; and providing vibrational energy through said housing, through said chamber formed of said plastic material, and through a clamping device that is securing said fluid container firmly, to said fluid treatment device during said passing of said liquid in said second direction;

whereby said relatively solid material is removed from said outlet orifice.

2. A method for removing relatively solid material from an outlet orifice of a fluid treatment device as defined by claim 1 including the step of providing vibrational energy to said fluid treatment device by using an ultrasonic transducer.

3. A method for removing relatively solid material from an outlet orifice of a fluid treatment device as defined by claim 1 wherein said step of providing a liquid to said chamber includes the step of filtering said liquid.

4. An apparatus for removing relatively solid material from an outlet orifice of a fluid treatment device including a fluid container with a plurality of orifices adapted to pass fluid in a first direction, comprising:

a housing including means to define a chamber sufficiently large to receive said fluid container;

said housing, including said means to define said chamber, being formed of a predetermined material of a rigidity sufficient to conduct vibrational energy;

clamping means located within said chamber adapted to support said fluid container sufficiently firmly to conduct vibrational energy to said fluid container during a cleaning cycle;

a cleaning liquid inlet port in said chamber at a predetermined location;

an ultrasonic transducer connected firmly with said housing and said chamber for generating vibrational energy for conduction through said housing, said chambers and said clamping means to said fluid container supported firmly during a cleaning cycle;

a pump connected with said inlet port to move a cleaning liquid through said chamber at a predetermined rate of flow and through said fluid container in a second direction opposite said first direction; and a filter connected with said pump and said cleaning liquid inlet port.

5. An apparatus for removing relatively solid material from an outlet orifice of a fluid container as defined by claim 4 wherein said vibrational energy is in the ultrasonic frequency range provided by generator means located adjacent a bottom surface of said chamber.

* * * * *